United States Patent [19]

Heinonen

[11] Patent Number: 4,564,969

[45] Date of Patent: Jan. 21, 1986

[54] MEANS FOR CLEANING FLOOR

[76] Inventor: Ahti Heinonen, SF-25470, Kisko, Finland

[21] Appl. No.: 606,614

[22] Filed: May 3, 1984

[30] Foreign Application Priority Data

May 17, 1983 [FI] Finland ..... 831734

[51] Int. Cl.[4] ..... A47L 13/24

[52] U.S. Cl. ..... 15/147 A; 15/228

[58] Field of Search ..... 15/147 R, 147 A, 147 B, 15/149, 229 R, 229 A, 229 AC, 229 AP, 229 B, 229 BC, 229 BP, 228

[56] References Cited

U.S. PATENT DOCUMENTS 2,325,598 8/1943 Fatland ..... 15/147 A 3,050,762 8/1962 Ballinger ..... 15/147 A 3,324,495 6/1967 Van Schwartz ..... 15/147 A

*Primary Examiner*—Edward L. Roberts

*Attorney, Agent, or Firm*—Andrus, Sceales, Starke & Sawall

[57] ABSTRACT

The means for cleaning a floor comprises a shaft (1), a frame (2) and a cleaning part (3) detachably attached to the frame. A drawback of prior art is the awkward affixing and detaching of the cleaning part. As taught by the invention, the frame has been provided with an end part 10 which is movable with reference to the frame and which has been arranged to press against the frame during the detaching and affixing operations and which has been disposed to fix the cleaning part when the ends (5, 14) of the frame is placed into the pockets (7', 7) of the cleaning part.

2 Claims, 4 Drawing Figures

MEANS FOR CLEANING FLOOR

Figure 1:
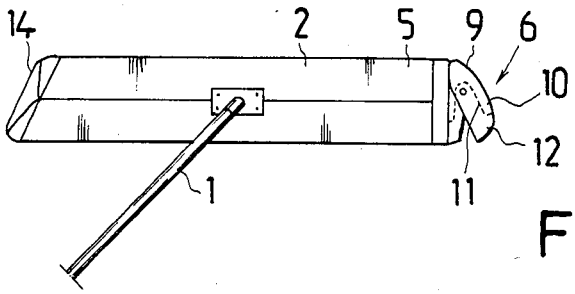

The present invention concerns a means for cleaning a floor, said means comprising a shaft, a frame pivoted to the shaft and a cleaning part detachably attached to the frame.

Cleaning means of this kind are used primarily for sweeping, but they are applicable also in floor washing. The tufts of the cleaning part attached to the frame collect dust and litter in an efficient way. After cleaning, the impurities caught in the cleaning part must be removed therefrom. This is best accomplished by detaching the cleaning part from the frame and, for instance, dusting the cleaning part. However, in mans of the prior art the detaching and remounting of the cleaning part is awkward. The frame must be slipped through a narrow slit, and thereafter the cleaning part has to be fixed on the frame e.g. by tying it with strings. This fixing mode is unreliable and inconvenient.

The object of the present invention is to introduce an improvement in the means of the prior art for cleaning floors. A further object of the invention is to introduce a means where the cleaning part is easily and effortlessly attachable to the frame without need for the person to bend down, and easily and effortlessly detachable from the frame. Moreover, it is an object of the invention to introduce a means which is simple to manufacture and to use, and wherein the cleaning part remains positively in its place during the cleaning operation.

The object of the invention is achieved by a means which is mainly characterized by that which is stated in the claims.

As taught by the invention, the frame is provided at least at one end with a clamping means which can be moved against said frame and away from said frame. The cleaning part comprises two pockets, the mouths of which are towards each other and the bottoms of which are in opposite directions. The frame is arranged to be inserted into the cleaning part with the ends of the frame in the pockets of the cleaning part withthe clamping means pressed against the frame The frame is also arranged to affix the cleaning part to the frame when the other end of the frame is pressed into the other pocket of the cleaning part. When the cleaning part and the frame are so shaped, the clamping means will lock the cleaning part to the frame and make sure that the cleaning part is kept in its place during the cleaning operation.

The cleaning part is advantageously provided at least at one end with strings or equivalent which are disposed in a configuration resembling a handle. This handle can be firmly grasped, and it is possible by pulling at its in the opposite direction with reference to the clamping direction of the clamping means to detach the frame from the cleaning part, because the clamping means presses against the frame. It is understood that the cleaning section can be detached from the frame with ease and speed.

The clamping means consists advantageously of an end part pivoted to the end of the frame and a spring disposed to urge said end part away from the frame. The end part can be moved with reference to the end of the frame by pressing the end part against the end of the frame. In addition, the end part can be advantageously arranged to be securable to the frame and releasable therefrom when desired. In that case, the end part is locked when the cleaning part is inserted and, possibly, when the cleaning part is being removed, whereas during the cleaning operation the locking of the end part is released and the clamping means secures the cleaning part to the frame.

Figure 2:
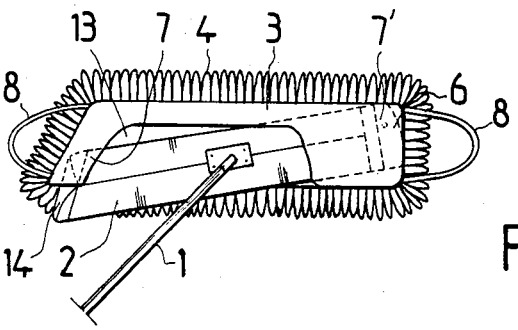
Figure 3:
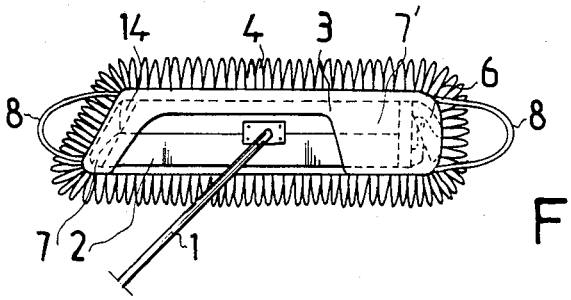
Figure 4:
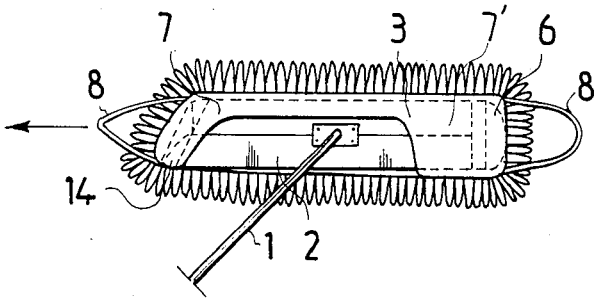

In the following, the invention is described more in detail by the aid of an exemplary embodiment, referring to the attached drawing, wherein FIG. 1 shows a frame according to the invention, in top view, FIG. 2 shows the frame of FIG. 1, half inserted into the cleaning part, in top view, FIG. 3 shows the frame of FIG. 1, inserted in the cleaning part, in top view, and FIG. 4 illustrates the removing of the frame of FIG. 1 from the cleaning part, in top view.

As shown in FIG. 1 the elongated frame 2 is provided at one end 5 with a clamping means 6. The clamping means 6 includes an end part 10 pivoted at one end 9 to the frame, and a spring 11 which has been disposed to urge the other end 12 of the end part away from the frame. The end part can be moved with reference to the frame by pressing the other end 12 of the end part against the end 5 of the frame, and after pressing has been discontinued, the spring will urge the end 12 away from the frame. The frame is pivoted to the shaft 1, the cleaning operation being carried out by means of holding this shaft.

The means further comprises, as shown in FIG. 2, a cleaning part 3, provided with tufts 4. In the embodiment of FIG. 2, the tufts 4 have been attached to the underside of the cleaning part, and in the top part has been made an aperture 13, i.e. two pockets 7, 7′ opening towards each other, wherein the ends 14, respectively 5 of the frame can be inserted into the cleaning part. End 5 of the frame 2 is pushed first into the pocket 7′ of the cleaning part, and when the clamping means 6 closes by effect of the bottom of the pocket 7′, the opposite end 14 of the frame is pushed into the other pocket of the cleaning part.

When the frame has been inserted in the cleaning part, the ends 14, 5 of the frame in the pockets 7, 7′ of the cleaning part, the clamping means 6 presses the end 14 of the frame against the bottom of the other pocket 7 of the cleaning part, being itself at the same time urged against the end of the other pocket 7′ of the cleaning part and thereby fixing the cleaning part tightly to the frame. The cleaning part and the frame are elongated in shape, and the frame is principally plate-like.

The cleaning part is provided with strings or equivalent members, which constitute handle-resembling structures 8 in the ends of the cleaning part 3. As illustrated by FIG. 4, the cleaning part is detachable from the frame by pulling the cleaning part in the direction of the arrow by the handle 8, whereby the one part 10 is pressed against the frame by the bottom of the pocket 7′ and the opposite end 14 of the frame is released from the other pocket 7 of the cleaning part, and the cleaning part can be detached from the frame so as to be cleaned. The cleaning part can be detached by holding the shaft with one hand and by giving a tug on the handle 8. The frame is inserted similarly, as illustrated by FIG. 2, in the cleaning part for instance by pressing the foot against the corner of the cleaning part and pushing the end 5, i.e. the clamping means 6 of the frame into the pocket 7′ of the cleaning part against its bottom and pulling the other pocket 7 over the other end 14 of the frame. In this manner, both the inserting and removing of the cleaning part are very easy to carry out, while on the other hand the clamping means affixes the cleaning part firmly in the frame and the cleaning part is held in place during the cleaning operation.

The invention is not exclusively confined to the embodiment example presented; on the contrary, it comprises all applications and modifications falling within the scope of the inventive idea presented in the claims.

I claim:

1. A means for cleaning a floor comprising:

a shaft (1);

an elongated frame (2) pivotally mounted on one end of said shaft, said frame having a pair of ends (5, 14), said frame being provided at at least one end (5) with a clamping means (6) which can be moved with respect to said frame toward and away from said frame, said clamping means comprising an end part (10) having first and second ends (9, 12), said first end (9) being pivotally mounted to said frame and, a spring (11) operatively associated with said frame and end part (10) to urge the second end (12) of said end part (10) away from said frame; and an elongated cleaning part (3) detachably affixed to said frame, said cleaning part having a pocket (7, 7') at each end thereof with a mouth and a bottom, the mouths of said pockets opening toward the center of said cleaning part and toward each other, said bottoms being opposite said mouths and adjacent the ends of said cleaning part, said frame being insertable into said pockets of said cleaning part by moving said second end (12) of said end part (10) toward said frame, said clamping means retaining said cleaning part on said frame when said second end of said end part (10) is moved away from said frame in said pocket by said spring (11).

2. A means according to claim 1 wherein said cleaning part has, at least at one end, a handle (8) formed of string for moving said cleaning part on said frame to move said second end of said end part toward said frame to permit removal of said cleaning means from said frame.

* * * * *